US008366347B2

(12) United States Patent
Odriozola Sagastume

(10) Patent No.: US 8,366,347 B2
(45) Date of Patent: Feb. 5, 2013

(54) WAVE-GENERATING APPARATUS

(75) Inventor: Jose Manuel Odriozola Sagastume, Donostia-San Sebastian (ES)

(73) Assignee: Instant Sport, S.L., Donostia-San Sebastian (ES)

( * ) Notice: Subject to any disclaimer, the term of this patent is extended or adjusted under 35 U.S.C. 154(b) by 200 days.

(21) Appl. No.: 12/528,428

(22) PCT Filed: Feb. 19, 2008

(86) PCT No.: PCT/ES2008/000089

§ 371 (c)(1),
(2), (4) Date: Oct. 2, 2009

(87) PCT Pub. No.: WO2008/102035

PCT Pub. Date: Aug. 28, 2008

(65) Prior Publication Data

US 2010/0017951 A1 Jan. 28, 2010

(30) Foreign Application Priority Data

Feb. 23, 2007 (ES) ..... 200700484

(51) Int. Cl.
*E02B 3/00* (2006.01)

(52) U.S. Cl. ..... 405/79; 4/491

(58) Field of Classification Search ..... 405/75–79; 4/491; 472/128

See application file for complete search history.

(56) References Cited

U.S. PATENT DOCUMENTS

| | | | | |
|---|---|---|---|---|
| 586,983 | A | 7/1897 | Wharton | |
| 3,802,697 | A | 4/1974 | Le Mehaute | |
| 3,913,332 | A | 10/1975 | Forsman | |
| 4,792,260 | A * | 12/1988 | Sauerbier | 405/79 |
| 5,171,101 | A | 12/1992 | Sauerbier et al. | |
| 5,564,859 | A | 10/1996 | Lochtefeld | |
| 5,899,634 | A * | 5/1999 | Lochtefeld | 405/79 |
| 6,019,547 | A | 2/2000 | Hill | |
| 6,716,107 | B2 | 4/2004 | Lochtefeld | |
| 7,252,047 | B1 * | 8/2007 | Baucom, Jr. | 114/284 |
| 2003/0119592 | A1 | 6/2003 | Lochtefeld | |
| 2005/0286976 | A1 * | 12/2005 | Lochtefeld et al. | 405/79 |

FOREIGN PATENT DOCUMENTS

| | | | |
|---|---|---|---|
| BE | 1013747 | A3 | 7/2002 |
| FR | 2848120 | A1 | 6/2004 |
| JP | 62204772 | A | 9/1987 |
| JP | 03-173586 | A | 7/1991 |
| JP | 05-230531 | A | 7/1993 |
| JP | 05-241392 | A | 9/1993 |
| JP | 08-126732 | A | 5/1996 |
| WO | 84/08695 | A1 | 12/1984 |
| WO | 0005464 | A1 | 2/2000 |
| WO | 03/005147 | A2 | 6/2003 |

* cited by examiner

*Primary Examiner* — David Bagnell
*Assistant Examiner* — Benjamin Fiorello
(74) *Attorney, Agent, or Firm* — Browdy and Neimark, PLLC

(57) ABSTRACT

Wave-generating apparatus (1) that is installed in an aquatic environment (3) and which comprises, as its main elements, at least one elongated profile (5) that moves tangentially in relation in relation to a uniformly-deep floor (4) by the action of a drive mechanism (6). As a result, a wave (2) forms on the profile (5) and moves along with the profile (2). The profile (5) is disposed to form an angle (8) other than 90° with the direction of displacement (7), the purpose being to generate a wave (2) with an escape area and which can therefore be surfed. Some parameters of the apparatus (1) may be adjusted for the purpose of changing the degree of difficulty of the wave (2) that is generated.

20 Claims, 9 Drawing Sheets

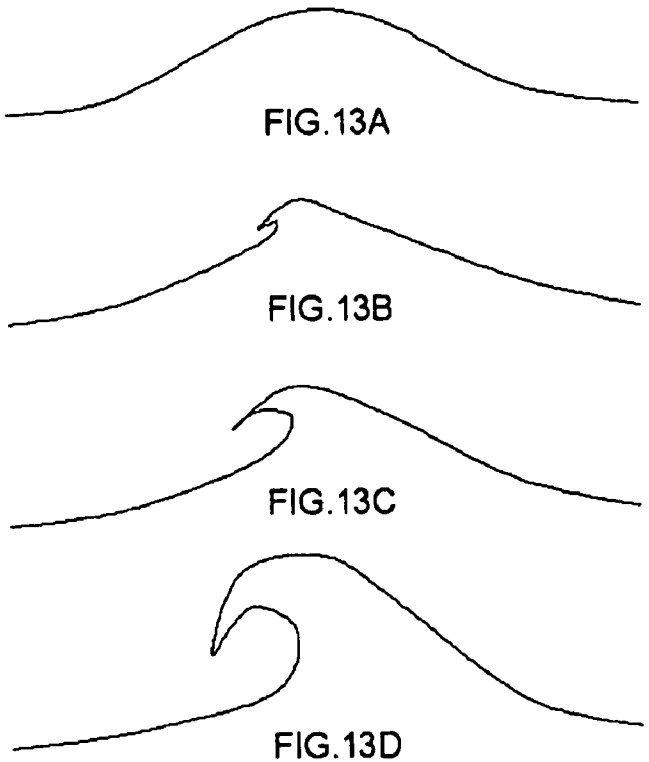
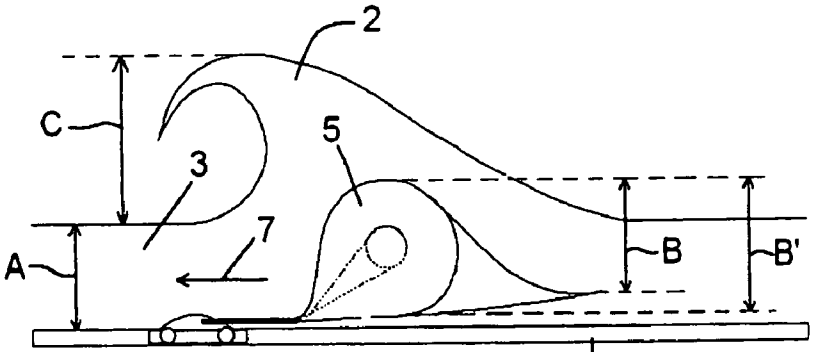
FIG.11
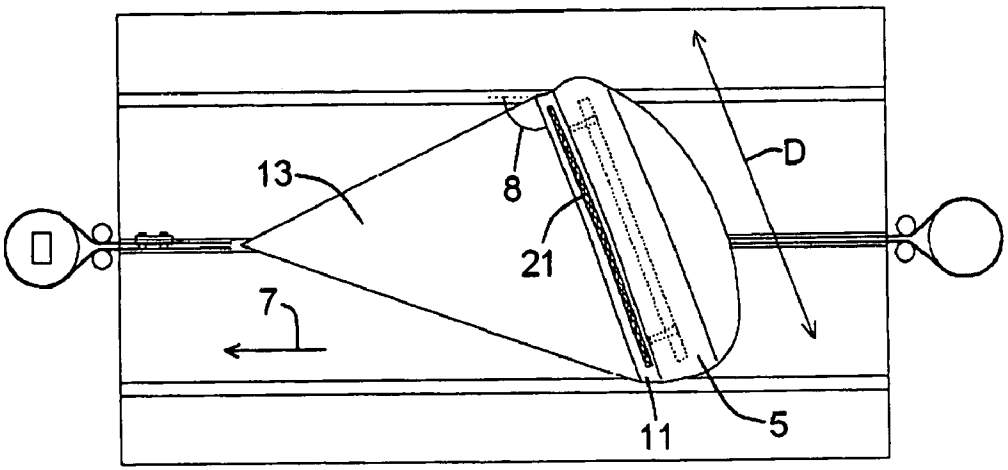
FIG.12

WAVE-GENERATING APPARATUS

TECHNICAL FIELD

The invention relates to a wave-generating apparatus for generating waves suitable for surfing.

PRIOR ART

Waves generated artificially in an aquatic environment may only be considered suitable for surfing (i.e. they may be surfed using the same techniques and the same surfboards as used for natural waves) if they meet a series of requirements. Firstly, they must be relatively large in size (with a minimum height of 0.5 m and preferably taller than 1 m). Secondly, they must move in relation to a fixed point and said displacement must occur at a similar speed to the speed at which natural waves move at the coastline (where the wave current is between −2 and 2 m/s and the wave speed, which is proportional to the height of the wave, is approximately 6 m/s for a wave that is 1.5 m high). Thirdly, the waves generated must present the so-called "escape effect", in other words, they must simultaneously present a breaking area and an area about to break, thereby allowing the surfer to surf by "escaping" from the breaking area to the area about to break. Fourthly, it is important that the area of the aquatic environment in which the generated waves travel is calm, in other words, that there are no waves or ripples on the surface and therefore no swell or ripple generated by the artificial wave. Fifthly, the interval between waves must be at least approximately 10-12 seconds (a wave known as a "solitary wave" being obtained, known as such because it is barely influenced by the waves that precede and follow it, because the particles of water between waves come to rest) as this gives surfers enough time to prepare themselves and catch the next wave without waiting any longer than necessary. Finally, the waves must have a minimum slope to enable a surfer to ride them, over which waves with a gentler slope for learner surfers or waves with a higher slope (even exceeding the vertical and breaking in the form of a tube) for advanced surfers.

Wave generators suitable for surfing must be capable of generating waves with the aforementioned characteristics while also meeting a series of additional requirements such as offering reasonable energy consumption, being able to generate different types of waves according to the needs of the surfer (enabling waves to be changed from one type to another relatively easily and quickly) and guaranteeing the safety of surfers at all times, ensuring, among other aspects, that when the surfer falls off the wave there is no possibility of them being injured by any part of the wave generator.

Figuring among existing wave generators are pneumatic wave-generator systems, in which, by injecting a large amount of air at low pressure into water chambers submerged in a swimming pool, water in the chambers is forced up into the swimming pool creating a wave front; vacuum-operated wave-generator systems, in which water from a swimming pool is absorbed into chambers, which are raised and then opened to allow the water to fall into the swimming pool; hydraulic systems, in which the water is pumped upwards in order to fill tanks that are then emptied immediately; and certain mechanical systems in which the wave front is created by pushing the water down as a result of the movement of one of the side walls of the swimming pool (an example of the mechanical system may be found in the document US 20040248780 A1). One aspect shared by all these systems is that when they are used to generate waves for surfing they are not energy-efficient, the time intervals between waves are either too long or too short (if the natural frequency of the systems is used in order to reduce energy consumption), and, among other aspects, they also require a very large initial financial investment due to the fact that the swimming pool must have a shore-type floor, suitable for causing the wave to break and to dissipate the ripple effect.

Other mechanical wave-generating systems are known where static waves are generated by launching water on to a profile. In these systems, in view of the fact that surfers and their boards have no momentum, the required technique has very little to do with real surfing techniques effected on natural waves in motion (as a parallelism, surfing on static waves can feel similar to trying to keep balance while riding a stationary bicycle on a conveyor belt). This technique is so different that it may even be considered a different sport. Examples of these wave generators may be found in U.S. Pat. Nos. 6,716,107, 5,564,859 and 5,171,101.

Mechanical wave-generating systems with a moving profile are also known. They comprise a moving profile or moving fold-down member that pushes the water in a certain direction in order to create the wave. Among the wave-generating systems with profiles, generator systems with a breaking point distant from the profile and generator systems with a breaking point near the profile are known.

In generator systems with a breaking point distant from the profile, the profile pushes the water substantially forwards to generate a wave front, with the particularity that the wave moves away from the profile and breaks at a relatively high distance. Breaking of the wave takes place due to the shore-shape (decreasing depth) with which the floor of the swimming pool or the place where the system is installed is built. These profiles push the water in such a way that the wave needs to travel a certain distance before taking a surfable shape. This means that the surfer does not surf on the start of the wave, close to the profile, but surfs where the wave breaks, at a certain distance from the profile. Therefore, these systems are safe for the surfer, and the area in which the profile moves may be even physically delimited from the surfing area. On another note, these systems must be able to generate waves that, even in losing height as they move away from the profile during the course of their movement, can still be surfed at a relatively long distance from the profile. For this reason, these systems are not energy-efficient when applied to the generation of waves suitable for surfing, as the other systems described previously. Additionally, these systems may require a very high initial investment as, among other reasons, the swimming pool must be large enough and the floor of the swimming pool must be provided with a topography that allows the wave to break correctly and to dissipate the ripples. Some examples of this type of system can be found in WO 0005464 and U.S. Pat. No. 3,913,332. The profiles shown in these patents are not hydrodynamic, i.e., provide a high resistance to water as they advance.

Generator systems with a breaking point near the profile are based on the fact that the profile pushes the water in such a way that a definite-altitude wave is created on top of the profile or right in front of the profile, said wave advancing at the same speed as the profile and never separating from it. In these systems, part of the volume of the wave is provided by the profile itself, it therefore not being necessary to move such large amounts of water as in other systems to generate waves suitable for surfing. As a result, these systems consume an acceptable amount of energy, thereby favouring their profitable use as a commercial surfing installation.

Generator systems with a breaking point near the profile can be broken down to surface-profile systems and deep-profile systems. In surface-profile systems, the profile is only slightly submerged, with the result that the film of water over said profile is very thin and the shape of the surface of the water is practically the same as the shape of the profile. To obtain a concave, tube-type wave, a profile with said concavity must therefore be used. An example of these types of systems can be found in documents US 20030119592 A1, WO 03051479 A2 and U.S. Pat. No. 4,792,260, in which ideal surfing waves are obtained by means of minimal energy consumption and using surface profiles designed with a very specific shape that determines the shape of the wave. Besides, the shape and depth of the floor is not relevant. However, in their lower sections (and, in some profiles, in their upper sections as well) the proposed profiles are provided with surfaces that are perpendicular to the forward direction of the profile, that are made of a rigid or semi-rigid material and that move at great speed. These surfaces may seriously injure the surfer in the event that he falls or crashes against the profile.

Deep-profile systems are capable of generating concave (tube-type) waves using non-concave profiles. In other words, unlike surface-profile systems, in deep-profile systems the shape of the wave is not determined by the shape of the profile but rather by the design and location of the floor or bottom surface located beneath the profile.

Examples of deep-profile systems are disclosed in WO 8200771, WO 8404695, JP8-126732, JP62-204772, JP52-41392, JP52-30531, JP3-173586 and FR2848120, where the system for generating waves uses a profile disposed on a flexible floor that is deformed in order to generate the wave. Although these are very simple systems in conceptual terms, they are difficult to create in reality due to the difficulty in finding materials and mechanisms for building a flexible floor capable of withstanding the weight of a wave (it should be remembered that each meter of wave front with a depth of one meter weighs one ton) and of simultaneously deforming in order to acquire the shape of the wave, all without posing a danger to the user.

U.S. Pat. No. 3,802,697 is also known and also refers to a deep-profile generator system. This generator system does not use a flexible floor but a fixed one, specifically taking the form of a fixed channel containing the fluid and inside which the profile moves. This system is deemed to present certain drawbacks: it is unable to generate waves with an escape effect as, due to the presence of the channel, the turbulent water of the part of the wave that has broken has nowhere to escape to and ends up filling the entire width of the channel; the walls of the channel make the ripples of the waves take too long to dissipate; the surfer may be thrown against the walls of the channel when falling off the wave.

It is an objective of the present invention to provide a wave-generating apparatus of the moving, deep profile, breaking point near the profile type, having a rigid floor, in which at least the following requirements are fulfilled: the waves generated are suitable for surfing, with the apparatus being capable of generating waves of the same quality as natural waves so that surfers do not have to change their technique or their equipment; the apparatus presents a low level of energy consumption; the apparatus guarantees maximum safety to the surfer.

BRIEF DESCRIPTION OF THE INVENTION

It is an object of this invention to provide a wave-generating apparatus that is installed in an aquatic environment and which comprises, as its main elements, at least one horizontally elongated profile that moves tangentially in relation to a floor with a uniform depth (i.e. substantially horizontal), and a drive mechanism designed to cause the profile to move. As a result of the movement of the profile in relation to the aquatic environment and the floor, a wave forms on the profile and moves along with the profile. The profile is substantially elongated and forms an angle other than 90° with the direction of displacement, in order to generate a wave that has an escape area and can therefore be surfed.

The profile pushes most of the water that is in front of the profile from the floor to the surface. For this purpose, the profile is preferably disposed from the floor or nearly from the floor to at least the surface or very close to it (or even above the surface of the water). As a result, the shape in which the water accumulates (i.e. the shape of the wave) does not depend on the shape of the profile but on the relationship between the depth of the floor in relation to the surface of the calm water and the height of the water that it is able to accumulate (i.e. the height of the wave). In turn, the height of the wave depends on the height, length, angle and speed of the profile, as shall be explained in detail below. In other words, the profile may take any shape that allows it to push water forwards and upwards, without the shape of the wave depending on the shape of the profile.

Although the profile may take any shape, in an especially advantageous solution the profile does not comprise any spaces or concavities intended to be directed towards the surfer when the wave-generating apparatus is operating (in other words, when the profile is moving), the aim being to enhance the safety of the surfer. Preferably, the profile is partially or totally hydrodynamic (having a low hydrodynamic resistance to advance coefficient) in order to reduce energy consumption and to minimize turbulence generation. In a specific embodiment the profile may present a fixed shape (e.g. a semi-rigid profile), regardless of whether it is moving or stationary. In another embodiment, the profile is inflatable, does not have a definite shape and is flexible so that during and due to its movement in relation to the floor, it takes on a hydrodynamic shape that is free of concavities directed towards the surfer. In this embodiment, a cylindrical inflatable profile is the easiest and cheapest solution to manufacture.

The shape of the wave is determined by the suitable combination of the aforementioned factors: firstly, the depth of the floor in relation to the surface of the calm water; secondly, the total height of the profile in relation to the floor when the profile is moving; thirdly, the length of the profile; fourthly, the angle of the profile in relation to the direction of displacement; fifthly, the speed at which the profile moves. The inventive apparatus may be designed to provide a fixed combination of these factors (providing a wave with a fixed shape as a result), although it will preferably be made in such a way that it offers more than one combination of values (more than one type of wave). As regards this last embodiment, the apparatus enables the configuration of at least one of the aforementioned factors for the selection of a wave with a lesser or greater degree of difficulty. In addition, the inventive apparatus also offers the possibility of changing the direction in which the profile moves, so that in one direction of movement the resulting wave is of the type known as a "right-breaking wave" (surfers on the wave are moving forwards to their right) and in the opposite direction of movement the resulting wave is of the type known as a "left-breaking wave" (surfers on the wave are moving forwards to their left). For these purposes and for all other functions the inventive apparatus presents a series of auxiliary members that are described in depth in the figures accompanying this description.

It is another object of this invention to provide a surfable wave-generating apparatus that is configurable. This means that the apparatus may be set up to generate waves of different types and sizes, in other words waves that are suitable for surfers of varying levels of experience. For example, the angle that the profile forms with the direction of displacement is preferably configurable so that the degree of difficulty of the wave may be changed (the smaller angle, the less difficult the wave).

The inventive apparatus presents a series of advantages over conventional wave-generating apparatus provided with a profile, either with a breaking point near the profile or with a breaking point distant from the profile.

In relation to apparatuses with a breaking point distant from the profile, the inventive apparatus, as with other apparatuses with a breaking point near the profile, does not require the floor of the aquatic environment to have a specific shape in order to determine when and how the wave breaks. Rather, the wave breaks with a shape that is controlled by the aforementioned profile parameters. Besides, the apparatus of the present invention advantageously requires less space to achieve a surfable wave, the wave already being surfable on top of the profile itself thanks to its elongated shape. Additionally, the apparatus of the present invention is more energy-efficient because of the preferred hydrodynamic shape of the profile.

Then, in relation to other known apparatuses that operate with a profile and with a breaking point near the profile, the inventive surfable wave-generating apparatus is able to guarantee maximum safety for the surfer while also generating waves of the same quality as natural waves. As has been explained, the use of a profile that is free of concavities and is preferably inflatable reduces risks. In contrast to surface-profile systems, the present invention lacks rigid or semi-rigid member (the profile or the base) or members that are provided with convexities, surfaces perpendicular to the movement or edges that may impact against the surfer located near the wave. Additionally, the apparatus of the present invention is feasible with a hydrodynamic profile in order to reduce energy consumption. Another advantage is that the wave generated by the apparatus can be surfed even at certain distance from the profile, which improves the security conditions for the surfer. The wave is surfable even at a certain distance thanks to the fact that the floor is near the profile, which favours that the wave maintains its slope and its optimum surfing shape as it gradually moves farther away from the profile.

In addition, the invention has an advantage over certain deep-profile systems in that the profile does not have to move inside a channel built for such a purpose. It is only required to move in relation to a floor, which may be positioned in a swimming pool, a lake, etc.

BRIEF DESCRIPTION OF THE DRAWINGS

Details of the invention can be seen in the accompanying non-limiting figures:

FIGS. 11 and 12 show the configurable parameters of an inventive apparatus.

FIG. 13 shows four types of wave obtained as a result of adjusting the parameters.

DETAILED DESCRIPTION OF THE INVENTION

Figure 1:
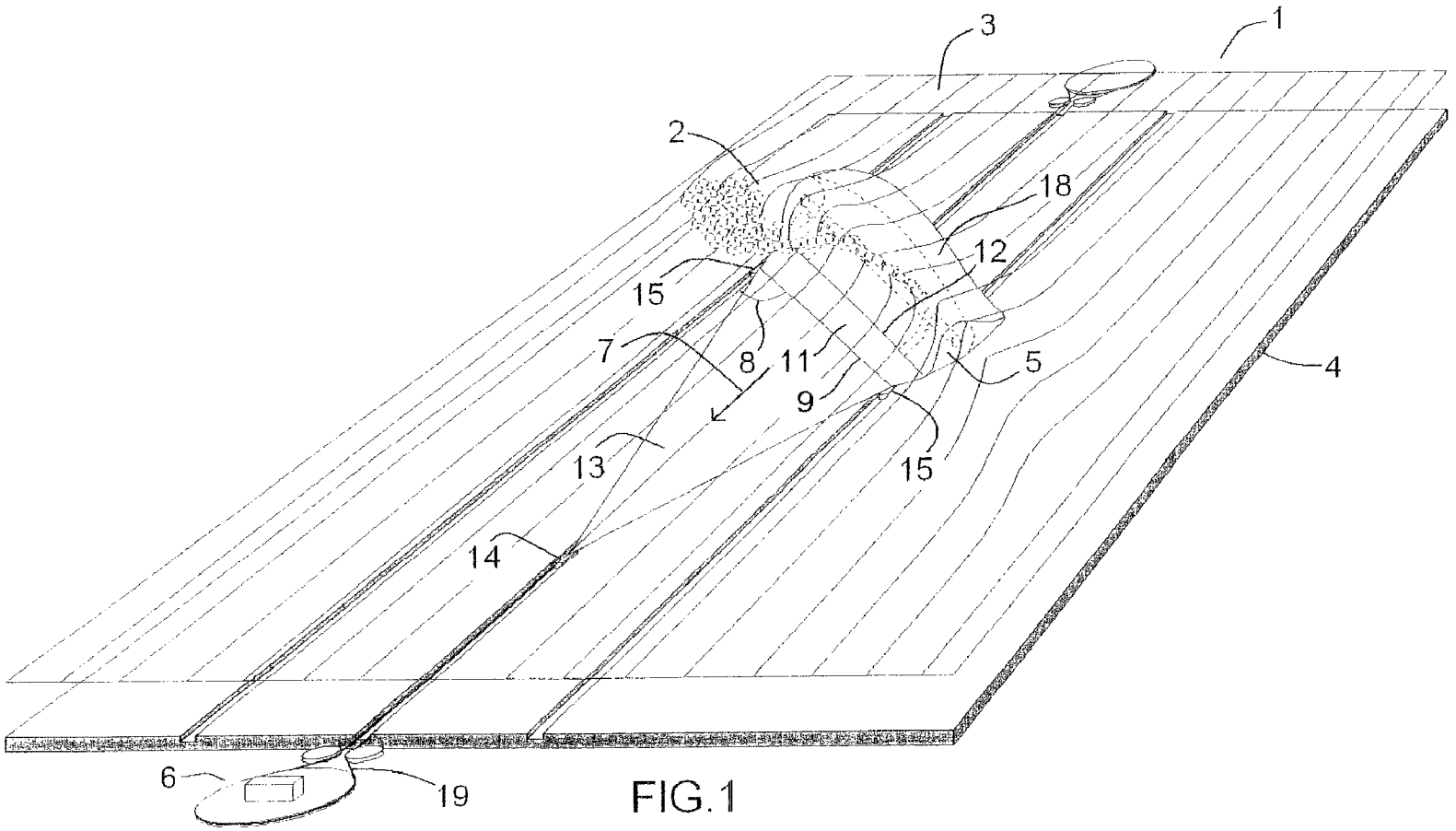
FIG. 1 shows a perspective of an embodiment of the invention.

FIG. 1 shows an embodiment of an apparatus (1) for generating waves (2) in an aquatic environment (3). The apparatus (1) comprises a floor (4) that is substantially horizontal, i.e. that has a uniform depth in relation to the surface of the aquatic environment (3). The floor (4) is formed, for example, by an essentially flat sheet of concrete built on the bottom of a lake or swimming pool, by compacted earth on the bottom of a lake or swimming pool, or by sheets of metal inside a collapsible swimming pool. Situated on the floor (4), the apparatus (1) comprises a substantially elongated profile (5), which moves in relation to the floor (4) in a direction of displacement (7) thanks to the action of a drive mechanism (6). When the profile (5) moves, a surfable wave (2) is created on top of it.

As shown in the figure, the substantially elongated profile (5) forms an angle (8) other than 90° with the direction of displacement (7). As a result, the front of the wave (2) generated on the profile (5), which will be parallel to the profile (5), has a front end and a rear end in relation to the direction of displacement (7). Should the rest of the configuration (depth of the floor; height, length and speed of the profile) be set up in such a way that it causes said wave front to break at a point on the profile (5) (preferably at the rear) or near the profile (5), part of the wave front does not break and is free of foam (the front part of the wave front) while another part of the wave front breaks and is covered with foam (the rear part of the wave front). A wave front of this type largely resembles a natural surfable wave. The value of angle (8) influences the degree of difficulty of the wave (2): the closer said angle is to 90°, the easier it is to surf the resulting wave. An angle (8) of 60° thus generates an easy wave, an angle (8) of 45° generates a wave (2) of average difficulty and an angle (8) of 35° generates a wave (2) that is difficult to surf. In a single apparatus (1) according to the invention, the angle (8) may therefore be adjusted in order to obtain waves of varying degrees of difficulty.

The floor (4) is open, i.e. it does not have side walls close to the rear end of the profile in order to provide the floor (4) with the shape of a channel. As a result, the foam generated on the breaking point may exit the profile through the rear end, preventing it from filling the wave front and keeping the front of the wave front free of foam. This part of the wave front that is free of foam, known as the escape face, makes the wave surfable.

The profile (5) is shaped in such a way that when the profile (5) moves in relation to the floor (4) it does so without spaces or concavities facing in the direction of displacement (7). This may be achieved by means of a rigid profile (5) that does not present said spaces and concavities, or by means of a flexible profile (5) of any shape, which when moving becomes deformed in such a way that it does not present said spaces or concavities.

Figure 2:
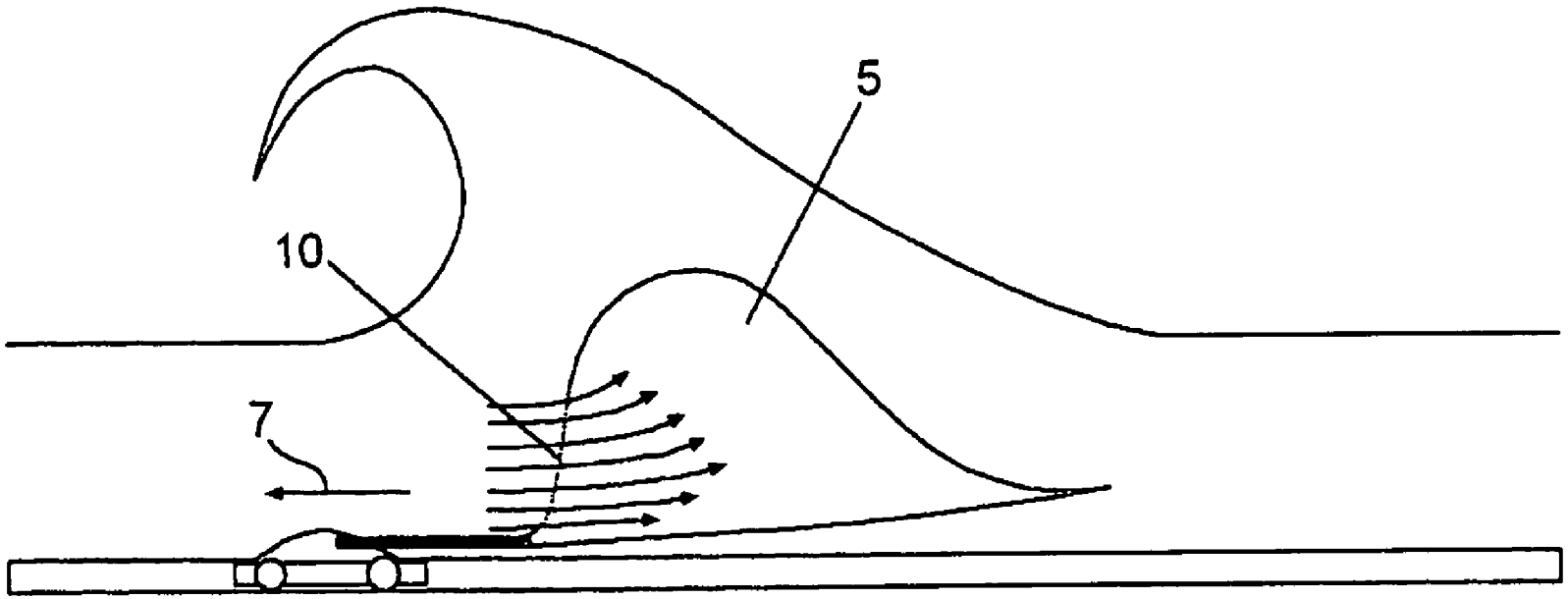
FIG. 2 shows a side view of an embodiment of the invention provided with a profile capable of self-inflating with water.

In a particular embodiment, the profile (5) is mostly or completely inflatable. The embodiment shown in FIG. 1, where the profile (5) is filled with air, is easy to manufacture and operates optimally. There, the profile (5) presents a cylindrical shape to begin with, and when it begins to move it becomes deformed until it acquires approximately the same shape of a droplet of water. This solution is advantageous as the profile (5) is light, which enables a reduction in the energy consumption of the apparatus (1). This figure also shows how the profile (5) is complemented by a rear hydrodynamic shape (18), to allow the water to exit more easily, reduce the consumption of the apparatus (1) and reduce the time it takes for the water to become still again before the next wave. Another embodiment can be seen in FIG. 2, which shows a profile (5) that is filled with water. The profile (5) is filled when, as a result of it moving in the direction of displacement (7), water enters the interior of the profile (5) through a water intake area (10). In this case the profile (5) is preferably designed so that when it is inflated it takes the form of a plane or paraglider wing. The water intake area (10) may take the form of a net, etc. The solution shown in FIG. 2 is advantageous as it allows the profile (5) to fill up by itself, thereby making the apparatus (1) easier to install and maintain.

As shown in FIG. 1, the profile (5) is attached to a triangular part (13), with the three points of said part (13) being connected to a tractor element (14) and two guiding elements (15) to pull and guide the profile (5) in relation to the floor (4). The elements (14, 15) form part of the drive mechanism (6), which comprises other elements such as cables (19) that pull on the tractor element (14). The lateral guiding elements (15) are preferably hidden beneath the floor (4) and absorb the lateral forces created due to the fact that the profile (5) forms an angle other than 90° in relation to the direction of displacement (7). The tractor element (14) is also preferably hidden, and constitutes the drive system of the profile (5). The presence of the part (13) ensures that the force exerted on the tractor element (14) is longitudinal only.

Figure 3:
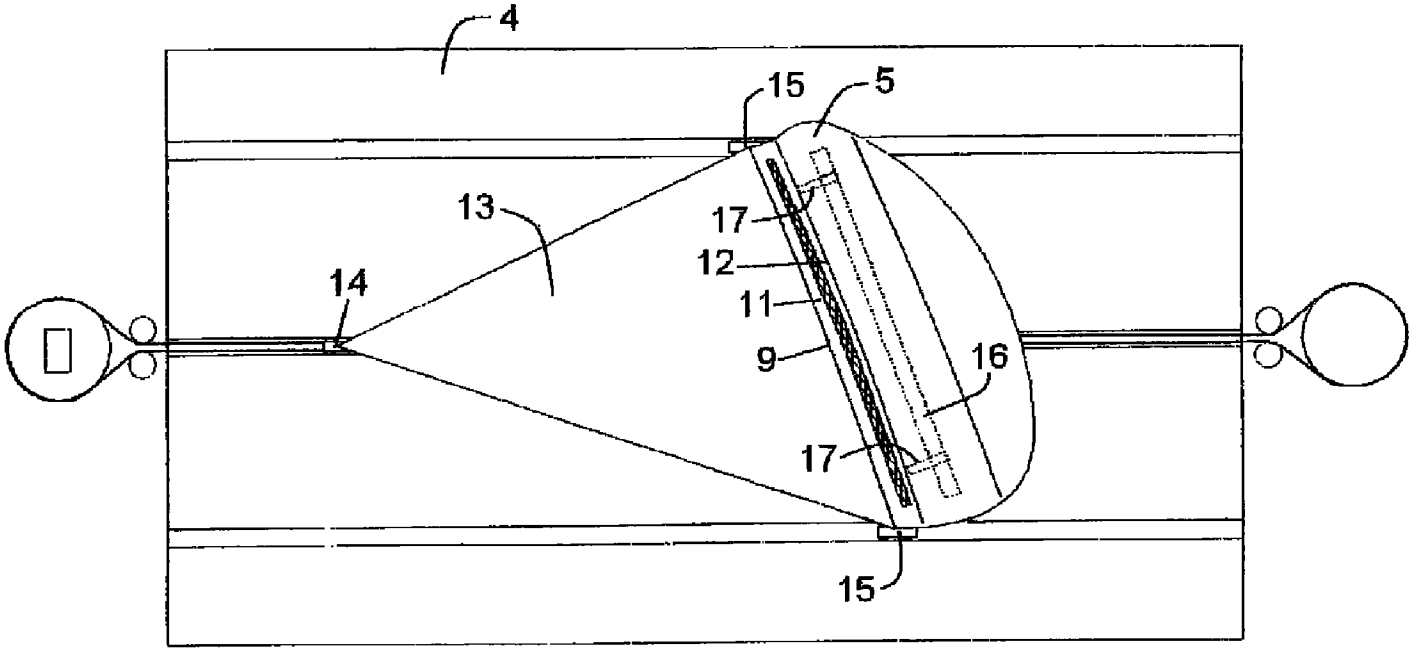
FIGS. 3 and 4 show a ground view and a side view of the embodiment of the invention shown in FIG. 1.
Figure 4:
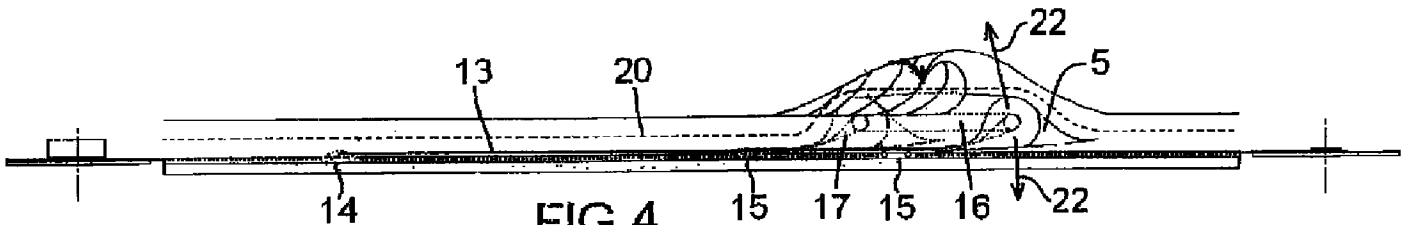

FIGS. 3 and 4 show two views of the embodiment of FIG. 1. These figures show that the profile (5) is able to tilt vertically in accordance with the arrows (22). Thanks to its ability to tilt, the profile (5) achieves vertical equilibrium without hardly any vertical forces being transferred on to the guiding elements (15). When the profile (5) is stationary, it emerges from the water due to its ability to float. When the profile (5) is moving it reaches its a state of equilibrium due to three separate forces: the weight of the water on top of the profile (5), the vertical thrust caused by the ability of the profile (5) to float, and the pressure of the water that passes beneath the tongue (11) and the profile (5). The weight of the wave is therefore borne by the floor (4) rather than the guiding elements (15). As a result, the fact that the profile (5) is allowed to tilt results in two fundamental advantages: firstly, there is no need to manufacture guiding elements (15) that are strong enough to bear the weight of the wave (bearing in mind that a 1.5-meter wave may weigh five tons for every meter of its length); secondly, there is no need to build a structure on top of the guiding elements (15) that is capable of bearing the profile (5).

In the embodiment of the figures, the apparatus (1) comprises a tongue (11) that allows the profile (5) to tilt vertically with greater freedom (amplitude) both when it is moving and when it is stationary. Specifically, as can be seen, the profile (5) is connected to one side (12) of the substantially-rectangular tongue (11), while the drive mechanism (6) act on the opposite side (9) of said tongue (11), i.e. they pull the guiding elements (15) and the tractor element (14)—the latter by means of the part (13)—. In addition, the tongue (11) ensures that the guiding elements (15) do not have to withstand vertical forces. It also forms an area on which surfers can fall when they lose their balance, cushioning said fall thanks to the tension of the tongue (11) and preventing the surfer from hitting the floor (4).

Figure 5:
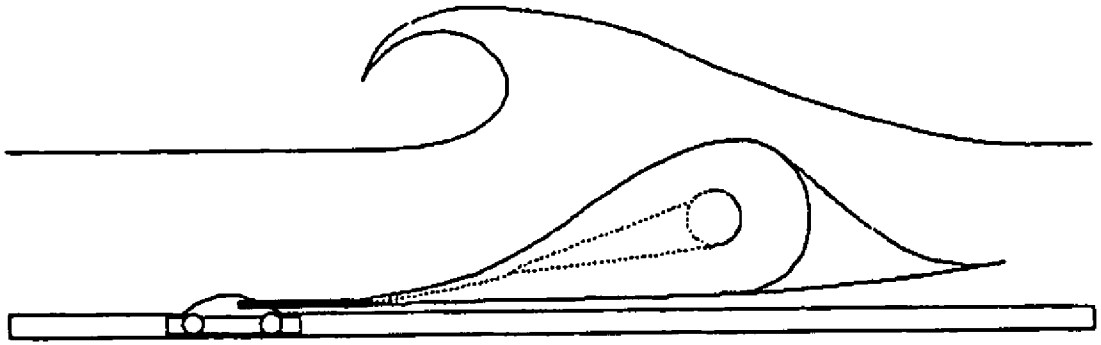
FIG. 5 shows a side view of an inflatable profile with a rigid bar and loose straps.
Figure 6:
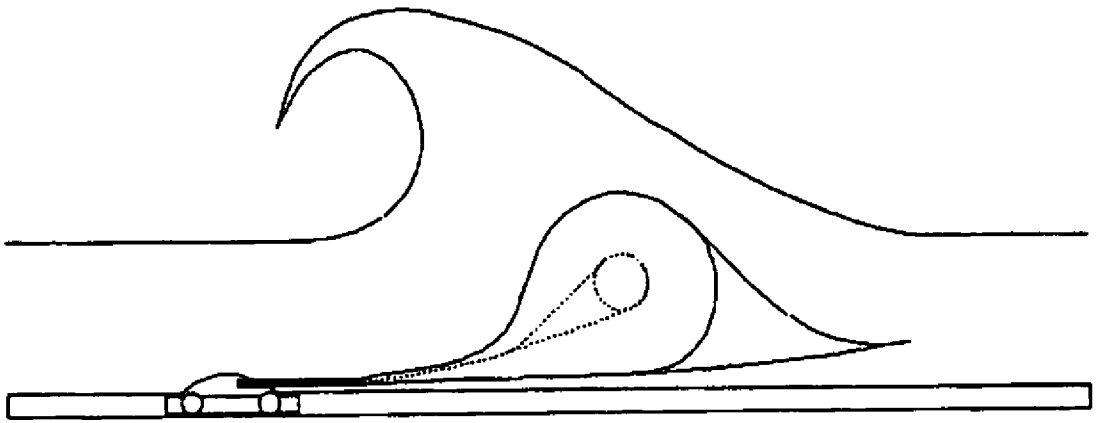
FIG. 6 shows a side view of an inflatable profile with a rigid bar and tight straps.

As shown in FIGS. 3 to 6, the profile (5) may comprise a rigid bar (16) in its interior to prevent the profile (5) from bending. In addition, the rigid bar (16) is situated in an adjustable position, thus enabling the shape of the profile (5) to be changed. The position of the rigid bar (16) may be adjusted by means of straps (17), for example. As shown in FIGS. 5 and 6, the loosening of the straps (17) creates a profile (5) that has a flatter and therefore lower shape when it is moving, thus creating a less steeply sloping wave. If, however, the straps (17) are tightened, the profile (5) becomes deformed and stands higher when it moves, thus creating a more steeply sloping wave.

FIG. 4 shows that the profile (5) and other members that move on the floor (4) are optionally covered with a safety layer (20), the purpose of which is to prevent the risk of surfers being pinched.

Figure 7:
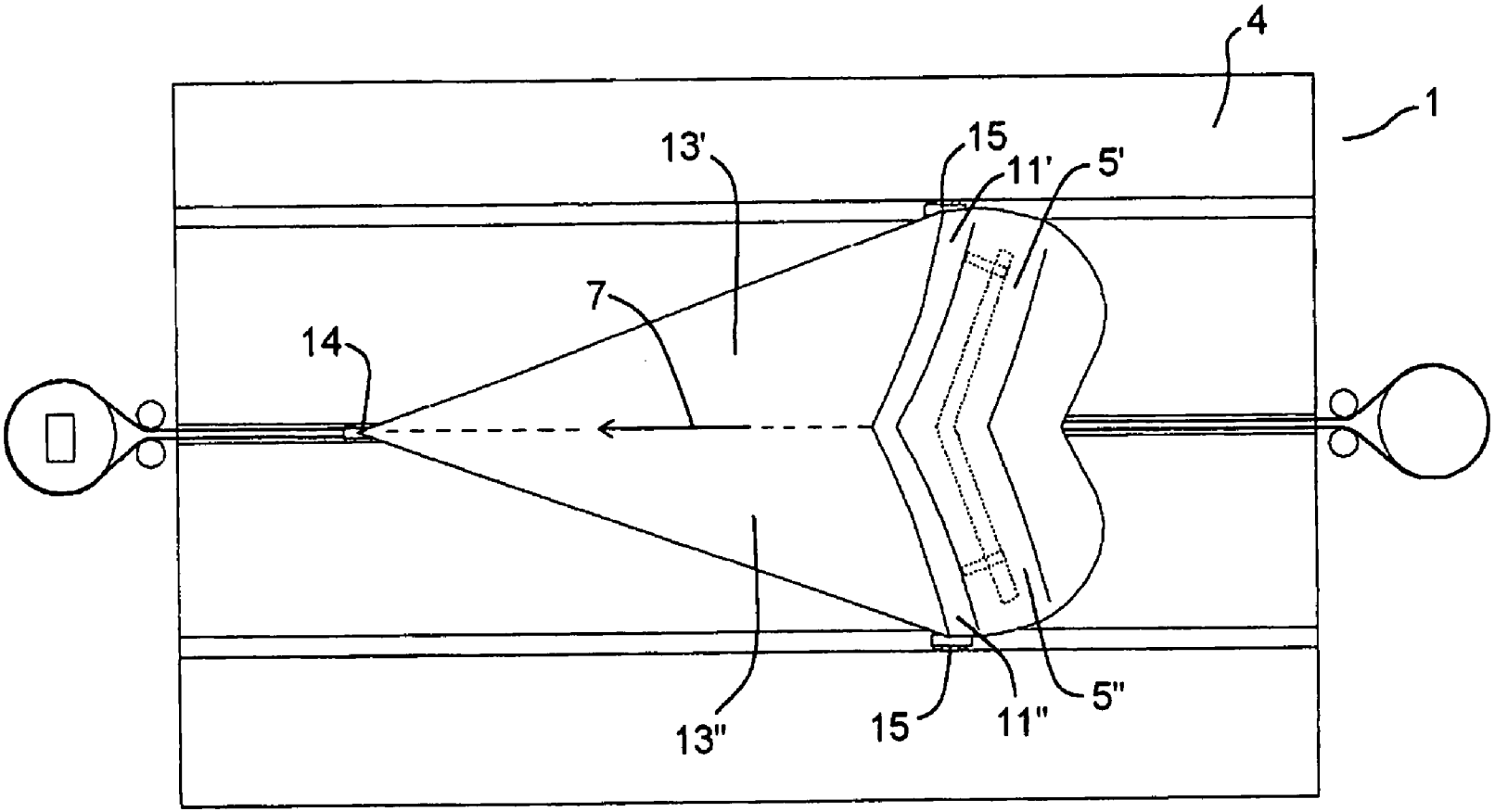
FIG. 7 shows a ground view of an embodiment of the invention provided with a double profile.

FIG. 7 shows another embodiment of the invention, in which the apparatus (1) comprises a double profile, i.e. a profile formed by two profiles (5', 5") of the type described above, disposed at different angles in relation to the direction of displacement (7), with the aim of generating a right-breaking wave and a left-breaking wave at the same time.

Figure 8:
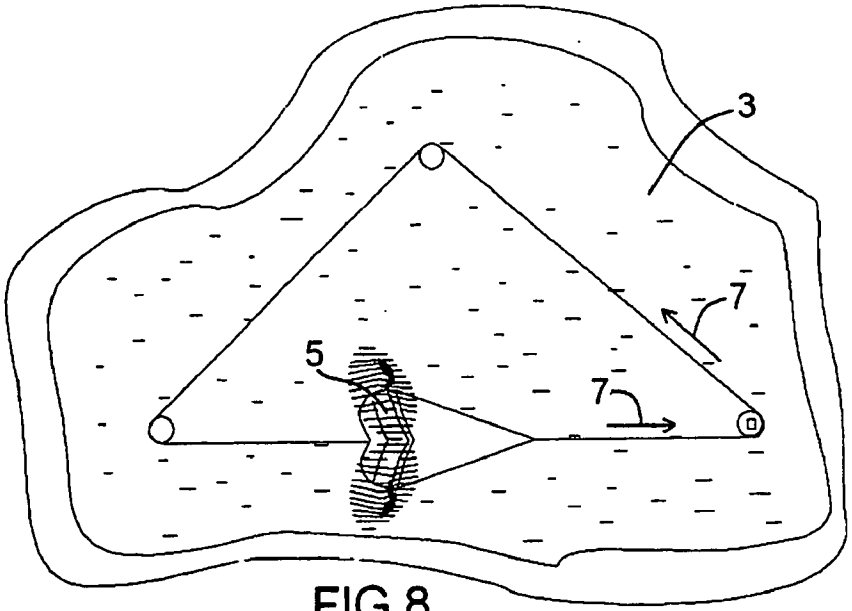
FIG. 8 shows a ground view of an embodiment of the invention with a loop trajectory and with two double profiles.
Figure 9:
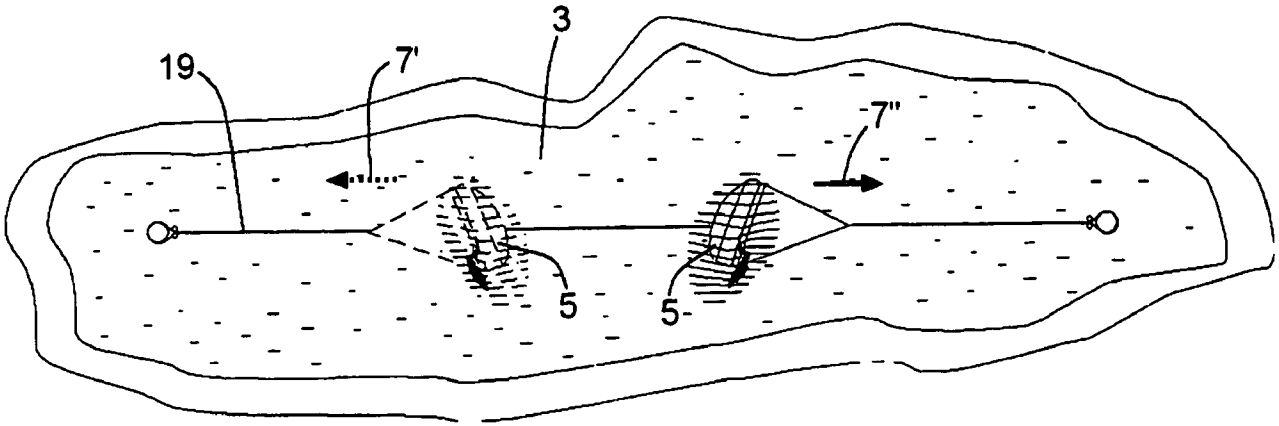
FIG. 9 shows a ground view of an embodiment of the invention with a linear trajectory and with a single profile.

As regards the drive mechanism (6), the invention is not limited to a specific mechanism and envisages the use of any type of mechanism capable of causing the profile (5) to move in relation to the floor (4). In a particular embodiment shown in FIG. 8, the profile (5) follows a path that is a closed loop, which means that the drive mechanism (6) only has to be capable of causing the profile (5) to move in a single direction, although it may optionally operate in both directions. In another embodiment, shown in FIG. 9, the drive mechanism (6) may cause the profile (5) to move in two directions of displacement: a first direction (7') of displacement and a second direction (7") opposite to the first direction (7'). In this particular case, the profile (5) follows a linear trajectory and has the ability to disconnect itself from a hook or other similar member connected to the cable (19) when it reaches the end of the trajectory, and to connect itself to said hook again to start the trajectory in the other direction. In this case the profile (5) pivots in the aforementioned manner every time its direction of displacement changes. FIG. 9 would also be feasible if, instead of this solution, a motor or drive system were provided and were capable of inverting the direction of rotation when the profile (5) reaches the end of the trajectory.

Figure 10:
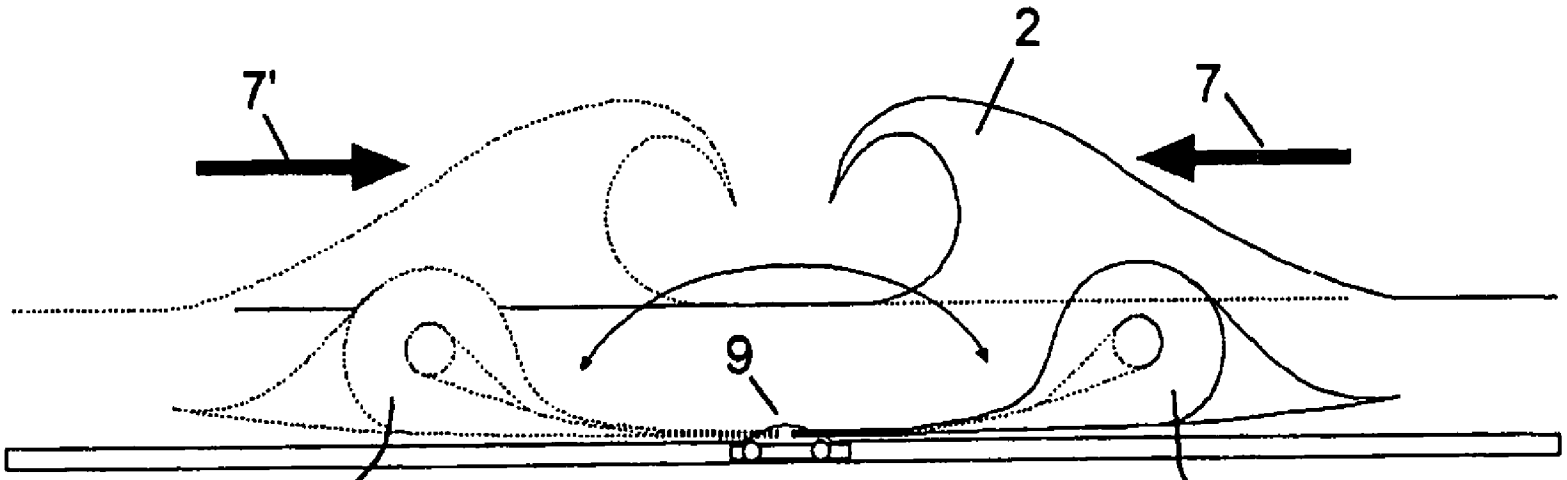
FIG. 10 shows the profile of FIG. 9, the direction of its displacement being reversed.

In the event that the drive mechanism (6) is capable of changing the direction (7', 7") of displacement of the profile (5), in an especially advantageous solution shown in FIG. 10, the profile (5) is designed to pivot and adopt a position that is symmetrically opposite, thereby enabling a wave (2) to continue to be generated on it. As a result, as can be seen in the figure, if, from an initial situation in which the profile (5) moves in a first direction of displacement (7), it changes to an opposite direction of displacement (7'), the profile (5) pivots on the side (9) of the tongue (11) and is suitably disposed for generating the wave in an opposite direction.

In the inventive apparatus (1) at least one of the following characteristics, shown in FIGS. 11 and 12, may be adjusted for the purpose of changing the shape of the wave (2) that is generated:

a) The height (B) of the profile (5) when the profile (5) is moving (it should be remembered that the profile may be inflatable or of a similar type, its shape varying in accordance with whether it is moving or not, its size during movement being an important factor). It should be noted that the height (B) of the profile (5) is practically the same as the height (B') of the profile (5) in relation to the floor (4), as the profile (5) rises from the floor (4) by a very small distance when it is moving.

b) The ratio between the height (B) of the profile (5) and the depth (A) of the floor (4) in relation to the surface of the aquatic environment (3) when the water is calm (said relationship is normally altered by varying parameter B as parameter A cannot be varied).

c) The length (D) of the profile (5).

d) The speed at which the profile (5) moves.

e) The angle (8) that the profile (5) forms with the direction of displacement (7).

Preferably, the inventive apparatus (1) is configured or constructed so that:

The length (D) of the profile (5) is at least four times greater than the height (B) of the profile (5).

The quotient between the height (B) of the profile (5) and the depth (A) of the floor (4) ranges between ½ and 3.

The speed of the profile (5) is approximately equal to the speed of a natural wave with a height equal to the height (B) of the profile (5).

The angle (8) is comprised between 90 and 35°.

An apparatus (1) is thus obtained in which the height (C) of the wave (2) is approximately equal to the height (B) of the profile (5). The table below details the types of wave (2) that may be achieved according to the ratio between the height (B) of the profile (5) and the depth (A) of the floor (4):

| | Height (B)/depth (A) | | | |
|---|---|---|---|---|
| | <½ | ½-1 | 1-3 | >3 |
| Type of break obtained | No break | Breaks gently | Breaks with a tube | Breaks with a pronounced tube |
| Use | Sloped wave, not sloped enough to surf | Sloped wave, sloped enough to surf, suitable for beginners | Sloped wave for advanced surfers | Sloped wave for highly proficient surfers, risk of dangerous falls |
| Wave (2) profile | FIG. 13A | FIG. 13B | FIG. 13C | FIG. 13D |

As FIG. 12 shows, the tongue (11) may be disposed with a permeable strip (21), formed by a net, for example, and capable of being open or closed in order to offer a different surface area. When open, said permeable strip (21) prevents part of the water from entering beneath the profile (5) when the profile (5) moves, with less water being pushed upwards. The shape of the wave (2) may be altered by opening or closing the permeable strip (21), thereby making the slope less or more steep, depending on the needs of the surfer. As a result, varying the degree to which the permeable strip (21) is opened may cause effects similar to those caused by varying the B/A quotient explained above, this alternative perhaps being easier to carry out.

The invention contemplates different embodiments to those shown in the figures. In one of them the profile (5) may pivot around a vertical axis rather than around the horizontal axis shown in the figures. In another embodiment, the profile (5) is disposed on a disc that may rotate in relation to the floor (4), with the result that the angle (8) may be adjusted without the need to alter the structure of the apparatus (1).

In addition, other members not shown in the figures may be added to the profile (5) shown in the figures with a view to improving its hydrodynamic performance and other characteristics, should this be necessary.

Figure 14:
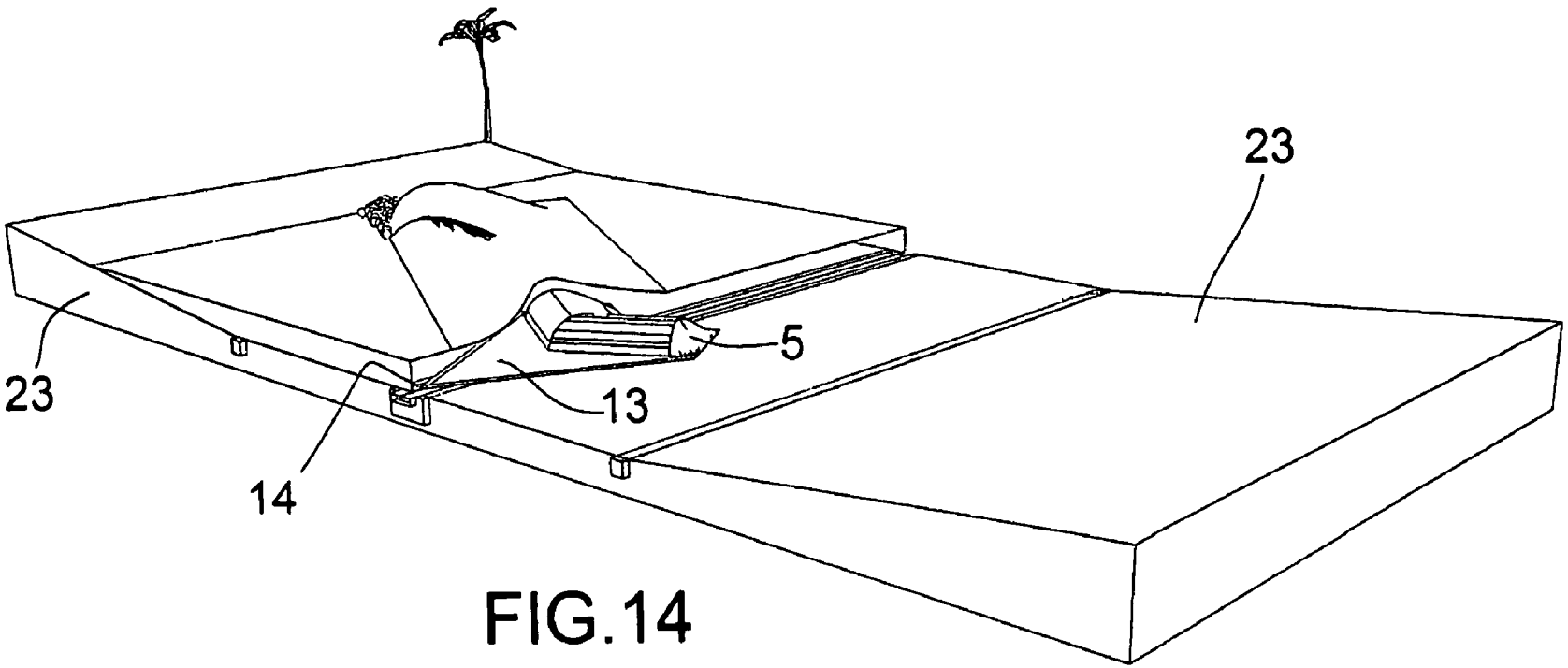
FIG. 14 shows another embodiment of the invention.

FIG. 14 shows a further embodiment of the apparatus according to the invention. In this embodiment, the open floor (4) comprises a series of shores (23) inclined less than 20°. The shores (23) cause the wave to grow taller and stronger, it even outgrowing the profile (5) if regarded from a tope view. For this reason, the surfer does not necessarily have to surf the wave (2) just on top of the profile (5), but rather can surf the part of the wave (2) that is outside the profile (5). The shores (23) can be submerged or can come out of the water.

To increase security, the apparatus of the present invention can also comprise a physical barrier (not shown in the figure) between the profile (5) and the surfable part of the wave (2), in case said surfable part (2) is not located right on top of the profile (5). The physical barrier can be a cork chain, a mesh or any other element that stops the surfer from getting in the profile's way.

Additionally, the profile (5) shown in the embodiment shown in FIG. 14 is double. In consequence, the wave (2) is double and only one tractor element (14) is needed, the guiding elements (15) not being necessary. The tongue (11) is also not necessary, as the part (13) is connected to the central front vertex on which the tractor (14) pulls and the part (13) can pivot vertically without the need of the tongue (11).

Alternatively to the figures, the full profile (5) can have a hydrodynamic shape, for example that of the wing of an airplane or of half a droplet of water.

Preferably, the floor (4) is covered with a certain material or built in such a way that it is gliding and that it stops the surfer from sinking, so that the surfer that falls off the wave can not be hit by the profile (5).

The invention claimed is:

1. A Wave-generating apparatus (1), for generating waves (2) in an aquatic environment (3), comprising:

an open floor (4) with a depth that is substantially uniform in relation to the surface of the aquatic environment (3), at least one elongated profile (5) over the floor (4) having a bottom surface adjacent to said floor (4), where the ratio between a height (B) of the profile (5) and the depth (A) of the floor (4) is between ½ and 3, whereby the ratio affects the shape of the wave, a drive mechanism (6) that causes the profile (5) to move in relation to said floor (4) in a horizontal direction of displacement (7), the bottom surface of the profile being closer to the floor (4) than to the surface of the aquatic environment, with a wave (2) thus being formed on the profile (5), where the profile (5) forms an angle (8) other than 90° with the direction of displacement (7).

2. The Wave-generating apparatus (1), according to claim 1, wherein the ratio between the height (B) of the profile (5) and the depth (A) of the floor (4) is between ½ and 1.

3. The Wave-generating apparatus (1), according to claim 1, wherein the ratio between the height (B) of the profile (5) and the depth (A) of the floor (4) is between 1 and 3.

4. The Wave-generating apparatus (1), according to claim 1, wherein the profile (5) is flexible and may become deformed when the apparatus (1) is moving.

5. The Wave-generating apparatus (1), according to claim 4, wherein the profile (5) is inflatable.

6. The Wave-generating apparatus (1), according to claim 5, wherein the profile (5) is inflated with air.

7. The Wave-generating apparatus (1), according to claim 5, wherein the profile (5) is filled with water when it moves in relation to the floor (4), the profile (5) comprising a water intake area (10).

8. The Wave-generating apparatus (1), according to claim 4, wherein the profile (5) comprises a rigid bar (16) in its interior in an adjustable position so that the shape of the profile (5) may be changed.

9. The Wave-generating apparatus (1), according to claim 1, wherein the profile (5) is connected to a part (13) to which, in turn, a tractor element (14) is connected that pulls the profile (5) with respect to the floor (4).

10. The Wave-generating apparatus (1), according to claim 1, wherein the profile (5) is attached to a triangular part (13), with the three vertexes of said part (13) being connected to a tractor element (14) and two guiding elements (15) to pull and guide the profile (5) in relation to the floor (4).

11. The Wave-generating apparatus (1), according to claim 1, wherein the profile (5) is connected to the drive mechanism (6) so that the profile (5) may tilt vertically and achieve vertical equilibrium at any given moment both when the profile is stationary and when the profile is moving.

12. The Wave-generating apparatus (1), according to claim 11, wherein the profile (5) is connected to one side (12) of a tongue (11), while on the opposite side (9) of said tongue (11) the drive mechanism (6) acts, so that the profile (5) may tilt vertically.

13. The Wave-generating apparatus (1), according to claim 12, wherein the tongue (11) comprises a permeable strip (21) with an adjustable surface.

14. The Wave-generating apparatus (1), according to claim 1, wherein the profile (5) comprises a rear hydrodynamic shape (18).

15. The Wave-generating apparatus (1), according to claim 1, wherein the full profile (5) has a hydrodynamic shape.

16. The Wave-generating apparatus (1), according to claim 1, wherein the drive mechanism (6) may cause the profile (5) to move in two directions of displacement: a first direction (7) of displacement and a second direction (7) opposite to the first direction of displacement (7).

17. The Wave-generating apparatus (1), according to claim 16, wherein when the drive mechanism (6) causes a change in the movement of the profile (5) from the first direction of displacement (7) to the second direction, or vice versa, the profile (5) pivots so that a wave (2) continues to be generated on it.

18. The Wave-generating apparatus (1), according to claim 1, wherein it allows at least one of the following characteristics to be adjusted: the height (B) of the profile (5) when the profile (5) is moving; the ratio between the height (B) of the profile (5) and the depth (A) of the floor (4) in relation to the surface of the aquatic environment (3) when the water is calm; the length (D) of the profile (5); the speed at which the profile (5) moves; and the angle (8) that the profile (5) forms with the direction of displacement (7).

19. The Wave-generating apparatus (1), according to claim 1, wherein the open floor (4) comprises shores (23) inclined less than 20°.

20. The Wave-generating apparatus (1), according to claim 1, further comprising a physical barrier between the profile (5) and the surfable part of the wave (2).

* * * * *